US006224228B1

(12) United States Patent
Frederick

(10) Patent No.: US 6,224,228 B1
(45) Date of Patent: May 1, 2001

(54) KEY LIGHT

(76) Inventor: W. Richard Frederick, 744 Bonniebrook, Mundelein, IL (US) 60060

( * ) Notice: Subject to any disclaimer, the term of this patent is extended or adjusted under 35 U.S.C. 154(b) by 0 days.

(21) Appl. No.: 09/363,716

(22) Filed: Jul. 29, 1999

Related U.S. Application Data

(60) Provisional application No. 60/094,482, filed on Jul. 29, 1998.

(51) Int. Cl.[7] ..... F21V 33/00
(52) U.S. Cl. ..... 362/116; 362/253
(58) Field of Search ..... 362/109, 116, 362/234, 253

(56) References Cited

U.S. PATENT DOCUMENTS

| | | | | |
|---|---|---|---|---|
| 1,966,550 | | 7/1934 | Handy | 240/2.25 |
| 3,085,149 | | 4/1963 | Giwosky | 240/6.4 |
| 3,119,564 | | 1/1964 | Zalman | 240/6.4 |
| 3,310,668 | | 3/1967 | Schwartz | 240/6.4 |
| 4,276,582 | * | 6/1981 | Burnett | 362/116 |
| 4,303,966 | | 12/1981 | Wolter | 362/116 |
| 4,392,186 | | 7/1983 | Cziment | 362/116 |
| 4,521,833 | * | 6/1985 | Wolter | 362/116 |
| 4,787,016 | | 11/1988 | Song | 362/116 |
| 5,181,927 | | 1/1993 | Song | 362/116 |
| 5,515,248 | | 5/1996 | Canfield | 362/116 |
| 5,541,817 | | 7/1996 | Hung | 362/116 |
| 5,730,013 | | 3/1998 | Huang | 70/395 |

* cited by examiner

*Primary Examiner*—Stephen Husar
(74) *Attorney, Agent, or Firm*—Jenkens & Gilchrist

(57) ABSTRACT

A light assembly for attachment to a key, and a method of attaching a light assembly to a key are disclosed. The light assembly comprises a battery, a light source and a switch. The battery is inserted into a hole in the key. The light source is mounted on a notch on the key. The switch connects the light source to the battery. The method comprises the steps of punching a hole into a core area of the key, mounting a light source onto the key, inserting a battery into the hole, and connecting a switch from the light source to the battery.

10 Claims, 7 Drawing Sheets

KEY LIGHT

CROSS REFERENCE TO RELATED APPLICATIONS

This application claims priority from Provisional Application Ser. No. 60/094,482, filed Jul. 29, 1998, and entitled "Key Light."

FIELD OF INVENTION

This invention relates to a light attached to a key, and a method of attaching a light onto a key.

BACKGROUND OF THE INVENTION

There have been many approaches to provide a small light associated with personal use keys. These allow the keyhole to be illuminated at night making it easy to find and insert the key. The most common type are separate lights attached to a key chain. The light is turned on and aimed at the keyhole. The appropriate key at the other end of the chain is then used. This is however a two hand operation and simply takes extra time plus these lights, though miniaturized, are usually relatively large, cumbersome to carrying around, aren't very bright and often look hokey. There have also been key holders with lights, light mechanisms that attach to the side of keys and factory produced keys with a light integrated into a plastic top. These are typically large, expensive or are only available if you purchase a luxury car. None of these meet the need to provide a method to easily add a very small, inexpensive, one hand use light to virtually any existing house, car or other key.

SUMMARY OF THE INVENTION

The present invention is a small, unobtrusive, inexpensive light that goes inside the top of almost any existing house, car or other key. It is a one-hand use device and the light aims where the key points. By using the latest light emitting diode (LED) technology and colors, this miniature light can not only illuminate a key hole but it's bright enough to function as a modest but readily available flashlight or supplementing light source. It's especially useful when used in short duty cycles of 15–20 seconds followed by several minutes or hours to refresh. This minimizes battery polarization. This is also the typical customer usage pattern and a battery will last hundreds of cycles when used this way. It can also be used, starting with a new battery, in continuous operation for about 15 minutes, should a need arise. The first step in installing a light assembly on a key is to add a site consisting of two punched areas to the core area in the customers existing key. This is done using a special punch press that has been added to the key-making center at a retail store. The new one-piece assembly then locks into this site, the battery is added and the cover is closed. The light is ready to used. Squeezing the sides of the key activates an internal switch to turn on the light. The light turns off when the pressure is released. The battery can be replaced by the customer. The assembly is designed so that it does not interfere with most existing key ring holes. This means the customer can continue to use his existing key ring and there's no additional bulky mechanism to carry around. A light can be added to as many keys as the customer wants.

There are a number of situations for which the present invention may be used to provide illumination. For example, the present invention may provide illumination to:

1. find the keyhole for your car, home, motorcycle, boat, etc.;

2. illuminate dark areas, including a walking path, outside, in dark buildings or unfamiliar surroundings like a motel room;
3. find coins or other items that have been dropped;
4. read maps, small print, gauges, meters, watches, compass, etc.;
5. check fluid levels under the hood;
6. provide security, e.g., see inside the car before getting in;
7. find light switches, doors, drawers, change light bulbs, etc.;
8. check on babies or sleeping kids without having to turn on lights;
9. see to change a flat tire or other quick repairs or services;
10. see in tight places and between, under or behind items; and
11. find and operate handles, levers, switches, etc., in a car or other vehicles.

There are many advantages of the present invention over the prior art. For example, the present invention is the smallest, lightest and most convenient light of its kind. It allows easy one-hand operation simply by squeezing the key to turn on the light. Also, no assembly is required as the key center assembles the unit within a couple minutes. Another advantage is that a new key is not necessary. It can be added to one or more existing keys, the size and shape with which the owner of the key is already familiar. Furthermore, the battery in the assembly can be replaced rather than purchasing a new assembly or a new key. The present invention has also adopted new super bright LED technology with sunspot yellow for high contrast, which makes reading red lines on maps easier. The present invention is also unobtrusive, and does not interfere with existing key chains.

BRIEF DESCRIPTION OF THE DRAWINGS

The following drawings form part of the present specification and are included to further demonstrate certain aspects of the present invention. The invention may be better understood by reference to one or more of these drawings in combination with the detailed description of specific embodiments presented herein.

DESCRIPTION OF ILLUSTRATIVE EMBODIMENTS Invention

Figure 1:
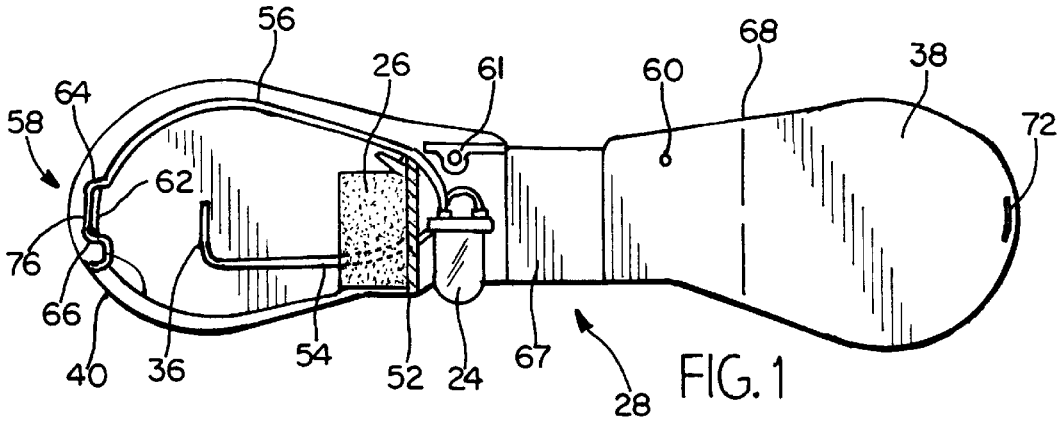
FIG. 1 is a front view of a light assembly in accordance with the present invention.

Referring to FIG. 1, the key light or light assembly 20 of the present invention uses only four parts, including a battery 22 plus three other parts 24, 26, 28 that are assembled at the factory producing a one-piece installation. The light assembly 20 is used in combination with a two-section punched site 30 produced at a store inside the top of a customer's existing key 32. (See FIGS. 17–22.) This combination allows this new standard light to be mounted on most existing keys 32. Special blanks are not needed and the existing key chain hole 34 can still be used. It is not necessary to purchase new keys or have them re-cut, which would introduce the potential for error and customer frustration that this could cause if the new key doesn't work properly. This makes the product very small and inexpensive. Creating uniform interior features, instead of trying to mate with exterior elements, eliminates the almost impossible problem of compatibility with the vast number of key blank sizes that are in normal use. It also allows the product to be very secure since it is integrated into the key 32. The four parts of the light assembly 20 are a button battery 22, a light emitting diode (LED) 24 with a switch 36 formed by bending one of the LED leads 54, a piece of resilient, double side tape 26 plus a plastic housing 28, which includes the cover 38 and latch 72. It is installed from one side. This simplifies assembly at the store. The entire mechanism 20 is slightly over ⅜" in diameter and only slightly thicker than the key 32. Specific features in the above parts could be included as part of the invention description but this combination is unique.

Concepts

Almost all keys and key copies are produced on relatively simple cutters. These machines and operators trained to use them are well integrated into locksmith or mass-market sales channels like hardware stores. These stores typically have key-making centers and retail consumers are accustom to going to them to have key work done. The concept starts by recognizing that these existing centers can offer this new technology with minimal additional training for their personnel. The only additional equipment is a simple hand or electric punch press occupying about one square foot and a supply of bulk light assemblies 20 and batteries 22. The press can be relatively simple since almost all keys are made from brass, which is fairly easy to punch. Tool life should be in the thousands of cycles. The store will then offer the service of adding a light to new or existing keys 32 along with selling the needed batteries 22 and future replacement batteries 22. This is something that store personnel will do. This product is not something a customer attaches or assembles at home. This is important since this approach allows a much smaller, thinner, cheaper, more versatile and robust design. Since there are hundreds of millions of keys in use and tens of thousands of stores that make them now, this approach can handle the potential volume while eliminating some of the problems in implementation that may occur without tooling and the use of trained personnel. This also eliminates the sales reluctance that customers have with items that require some assembly. The store does it all.

Figure 14:
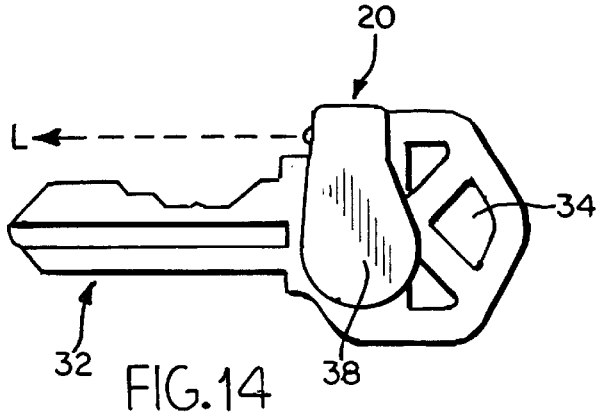
FIG. 14 is a front view of a light assembly attached to a key in accordance with the present invention.
Figure 15:
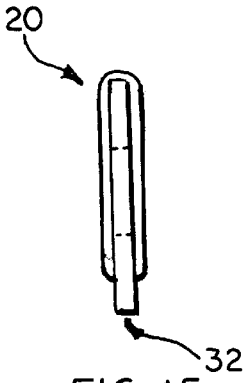
FIG. 15 is a side view of the assembly and key of FIG. 14.
Figure 16:
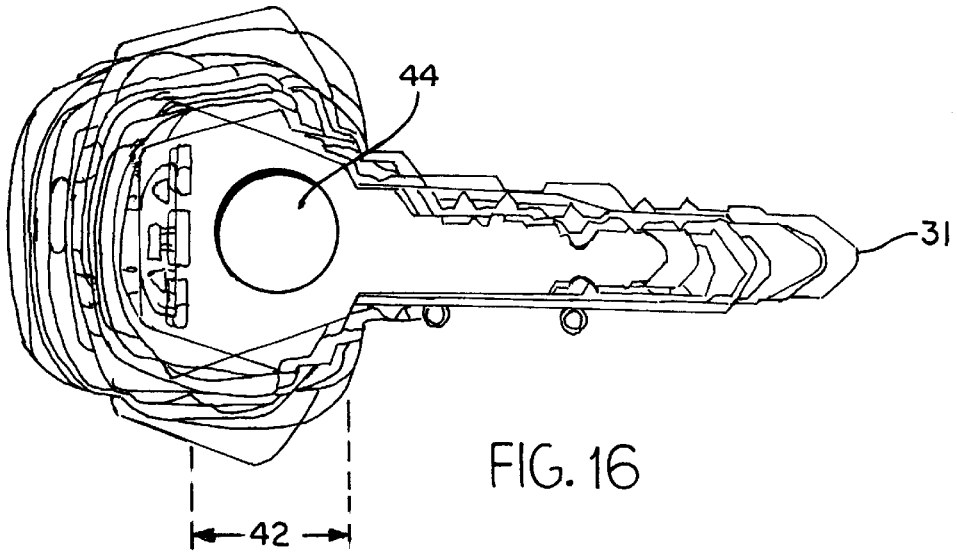
FIG. 16 is a front view of various shapes of keys that may be used with the light assembly of the present invention.
Figure 17:
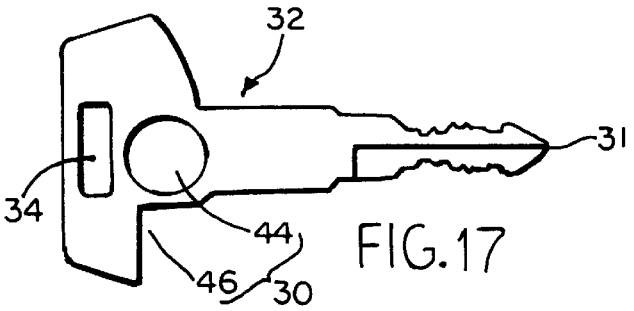
FIGS. 17–22 are front views of individual keys that may be used with the light assembly of the present invention.
Figure 18:
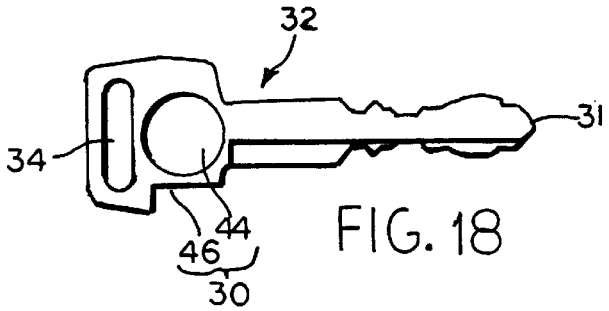
Figure 19:
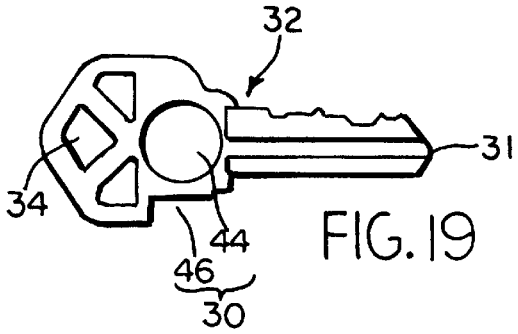
Figure 20:
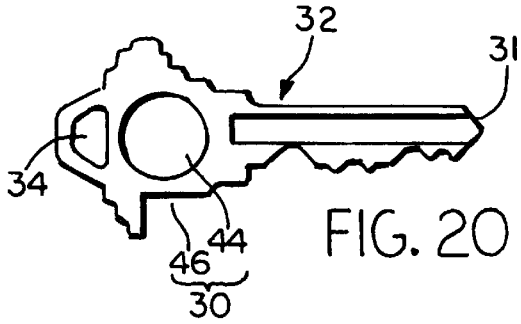
Figure 21:
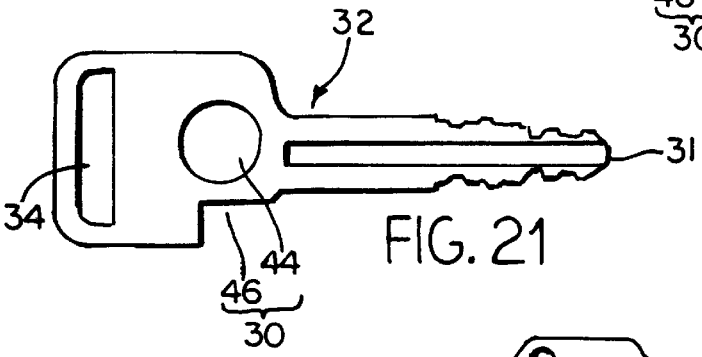
Figure 22:
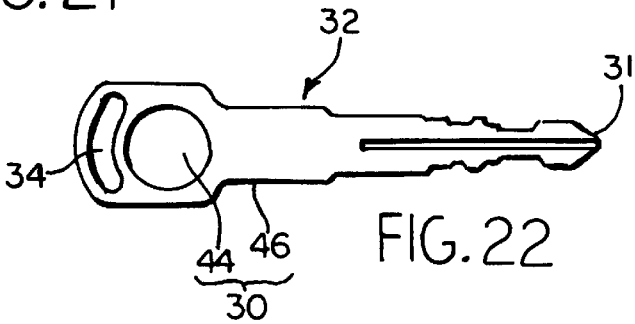

The second implementation concept recognizes that there is a core area 42 in almost every key that is large enough for this special miniature light assembly 20. It is at the top where the key 32 is grasped and this area 42 is always relatively large since it's designed to be gripped in order to turn the key 32. By punching out metal from the core 42, a standard site 30 can be produced. This site 30, does not intrude into the area 34 used to hold the key on a ring or chain. It also leaves enough material around the perimeter of the site 30 so that the key 32 isn't weakened. The site 30 includes features to aim the light L at the end 31 of the key 32 so that it's pointing where the key 32 is pointing. (See FIG. 14.) This eliminates the step of aiming the light separately, which is needed with key chain lights. In some instances where there is a large metal top on the key, the top of the light assembly 20 will be lower than this portion of the key 32. The metal will be above the new assembly 20, but this doesn't present any problems in punching or use. In the few instances where this occurs, any sharp edges can be removed using the existing deburring brush on the key cutting machine or a hand file and wire brush. In smaller keys 32 the assembly 20 will extend above the top of the metal. This actually makes the key 32 easier to turn, which is an additional advantage. Implementation in both large and small keys 32 is shown in FIGS. 7, 17–22 and 26.

Construction

Figure 23:
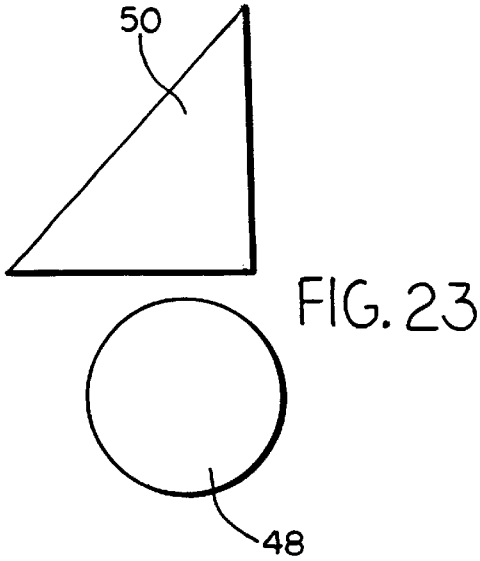
FIG. 23 is a top view of punches used to form the keys of FIGS. 17–22.

In the preferred embodiment of a key used with the assembly 20, the center hole 44 is round and the edge notch 46 contains a right angle. (See FIGS. 7, 17–22 and 26.) This also helps anchor the assembly 20 so that it can't rotate around the battery 22. This notch 46 can be produced with a square, rectangular or right-angle triangle punch element. Round 48 and triangular 50 elements (as shown in FIG. 23) are preferred since they minimize the width or area needed to hold the tooling and this reduces the size of the punch press that is needed. An additional purpose of these simple shapes is to extend tool life and lower the initial cost of the dies. There could be punched features to guide, key and lock the mechanism in place but these aren't used in the preferred embodiment. They would allow more versatility in additional versions but would be slightly larger, have a cost adder and would probably shorten tool life.

Referring to FIG. 1, a piece of double-sidedtape 26 is incorporated in the top of the light assembly 20 just below the LED separator 52. It electrically insulates the wire 54, provides the spring action for the switch 36 and holds the mechanism 20 to the key 32 during assembly. This tape 26 also assures that the assembly 20 can't be slid or rotated on the key 32 after the cover 38 is closed. The tape 26 can have backing paper (not shown). There are no complex assembly or alignment steps. The punch tooling and the hole shapes 48, 50 do the work. It is anticipated that with market acceptance, key blanks already containing the needed site 30 will become available. This will eliminate the need for the punching operation when they are used. These blanks are not necessary to proliferate the technology, however. This is a very significant advantage of this technology since stores will not need to put in a large inventory of new type blanks for a new product that doesn't have a proven track record. They do not want to make this type of inventory investment, plus they usually don't have the space for it either.

Figure 13:
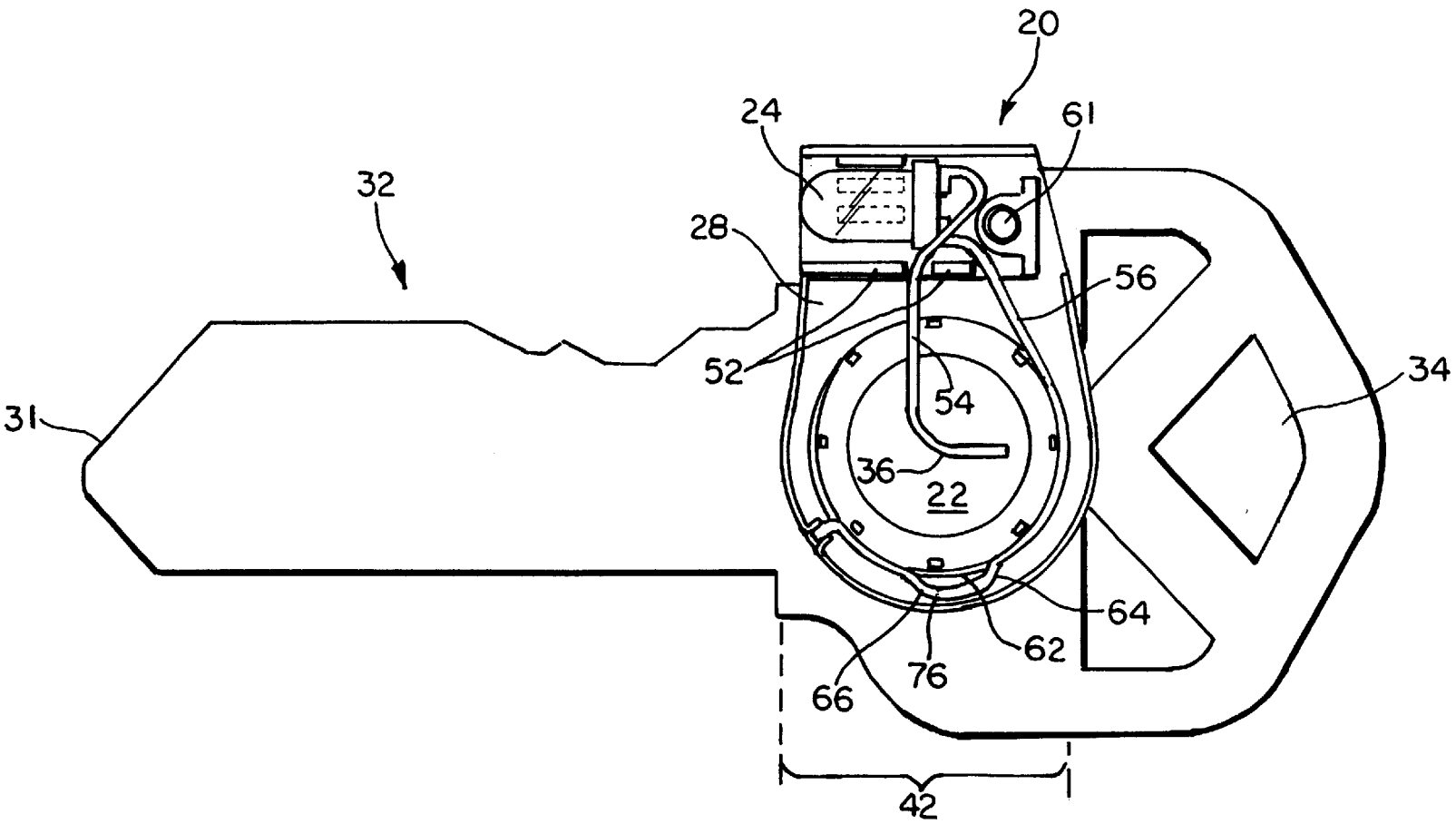
FIG. 13 is a front view of a light assembly attached to a key showing all of the components within the assembly.

The next part of the technology is the design of the light mechanism 20 that is placed in the site 30. This is shown in FIGS. 1 and 13 and installation in a key 32 is shown in FIGS. 8–12. It is expected that one design will fit in at least 80% of the keys 32 and it by itself, or at the most two or three additional standard type mechanisms 20, will meet the needs of the market place. It is anticipated that multiple colors of the same part will be offered to make it easier for customers to identify individual keys 32 plus provide some aesthetic appeal. Keys 32 that have thick plastic tops will need to be re-cut using standard metal top blanks which will then be punched to add the site.

Figure 10:
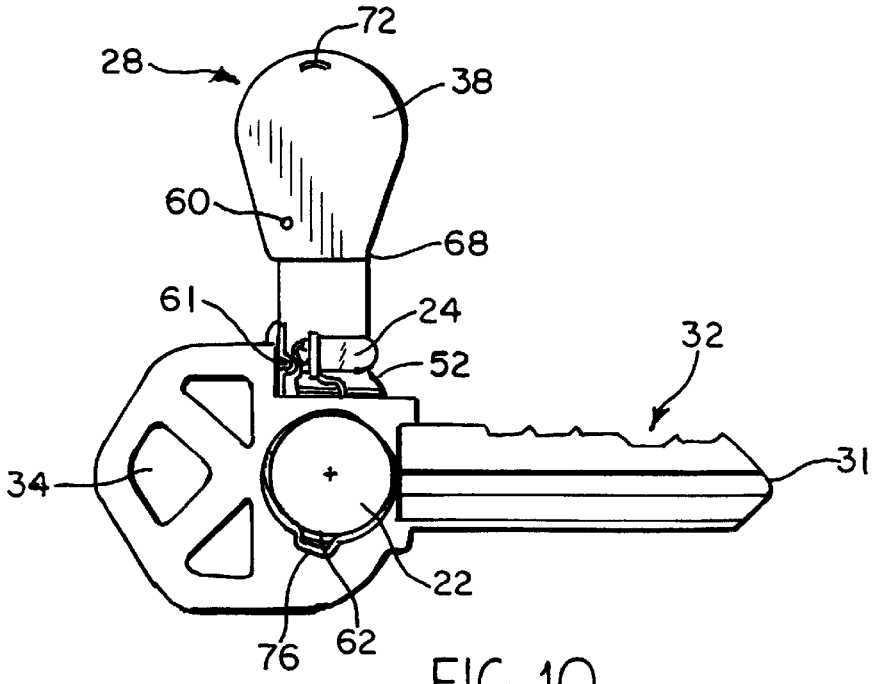
FIG. 10 is a front view of a light assembly attached to the back of a key in accordance with the present invention.
Figure 11:
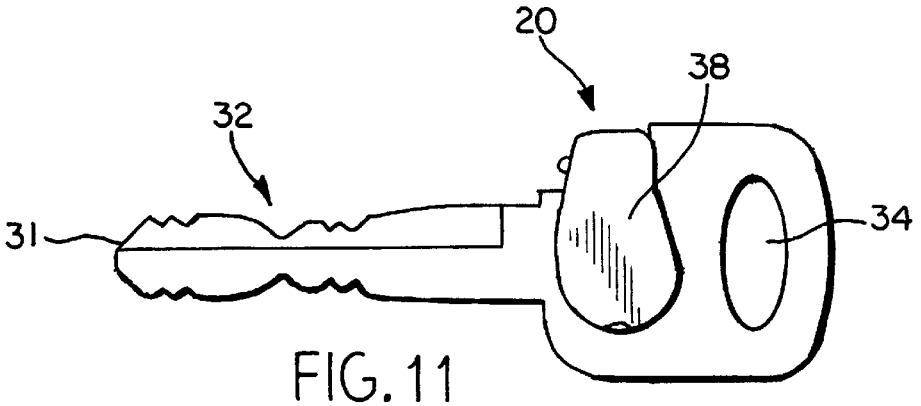
FIGS. 11 and 12 are front views of a light assembly attached to a key in accordance with the present invention.
Figure 12:
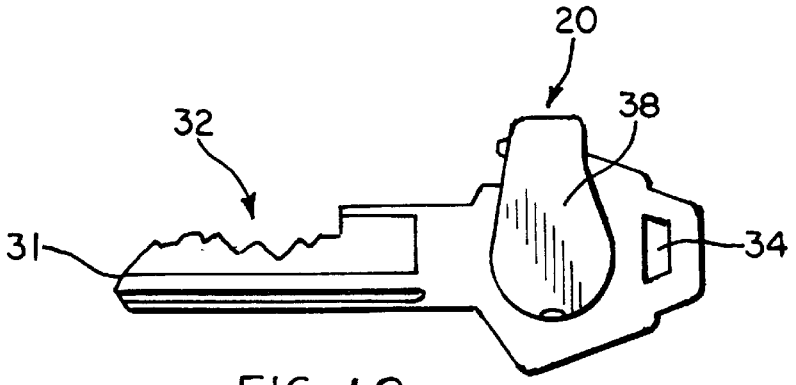

The light mechanism 20 is a one piece, factory produced product. A key blank is not included or needed. The light mechanism 20 is simply placed into the punched site, fitting the latched end 58 first, then pivoting it until the tape 26 makes contact. The wire latch 76 and tape 26 hold it to the key 32 initially. Next the battery 22 is inserted by a store employee and the cover 38 is closed and locked. This one side drops in and squeeze shut installation, simplifies assembly and reduces the need for employee training. It also minimizes the possibility for errors. In addition when the battery 22 is installed, as shown in FIG. 10, it prevents the wire latch 76 from moving inward. This literally locks the bottom of the mechanism 20 into the punched hole 44. The top half of the cover 38 has a post 60 that goes into a hole 61 when the cover 38 is folded to anchor the case 28 around the LED 24, and mechanically hold the tape 26 against the key 32 so that it can't come loose. This locks the top. The post 60 and hole 61 also make it compatible with a wide range of key thickness. These two locking methods combine to assures that the light assembly 20 doesn't loosen or rotate as the key 32 is being turned in normal use.

Figure 5:
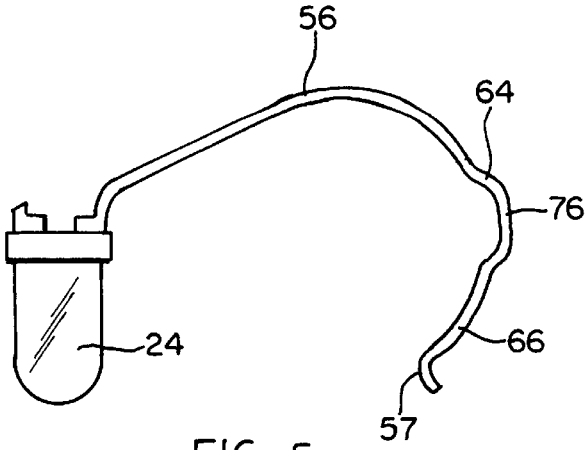
FIG. 5 is an exploded back view of the LED and second wire of the assembly of FIG. 1.
Figure 4:
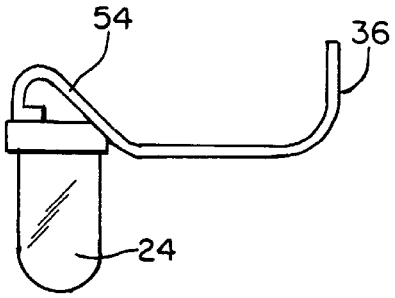
FIG. 4 is an exploded back view of the LED and switch of the assembly of FIG. 1.
Figure 6:
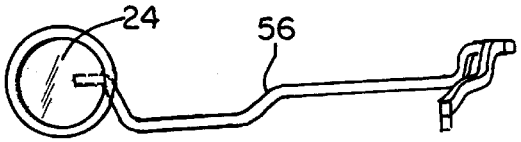
FIG. 6 is an exploded bottom view of the LED and second wire of the assembly of FIG. 1.
Figure 7:
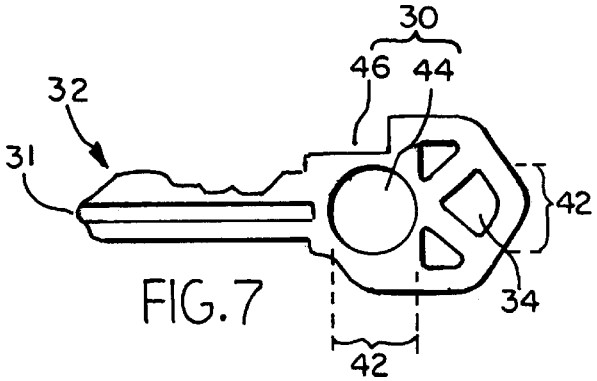
FIG. 7 is a front view of a key to be used with a light assembly in accordance with the present invention.

When it's time to replace the battery 22, a small lever is inserted under the edge of the cover 38 and it is pried up. This releases the cover latch 72. Typically the lever would be the tip of a knife or small eyeglasses type screwdriver. The same lever is then inserted in the space 62 between the two leads 64, 66 forming a latch 76. The side of the battery 22 is lifted and then it's removed and replaced using your fingers. (See FIG. 10.) In the preferred embodiment, one of the LED leads 56 is bent so that it makes the electrical connection to the punched hole 44 in the key 32 which serves as the battery holder. (See FIG. 5.) The tip of the lead 56 includes a bend 57. The other lead 54 is bent and insulated with the tape 26 so that it functions as a switch 36. (See FIGS. 1 and 4.) If a metal stamping approach were used, a dome switch features could be implemented which would provide a tactile feel. The preferred embodiment simply uses double sided resilient tape 26 for the spring-action to open the circuit when finger pressure is removed.

Figure 2:
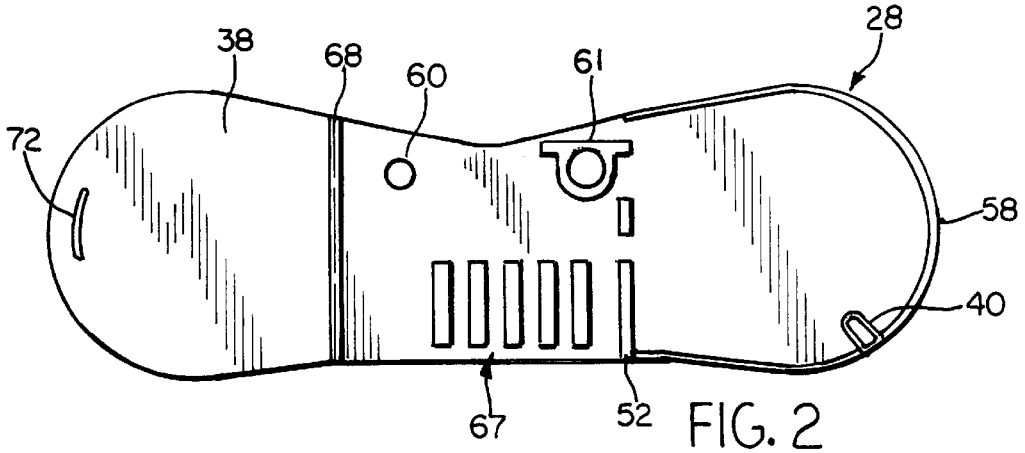
FIG. 2 is a front plan view of the housing of the assembly of FIG. 1.
Figure 3:
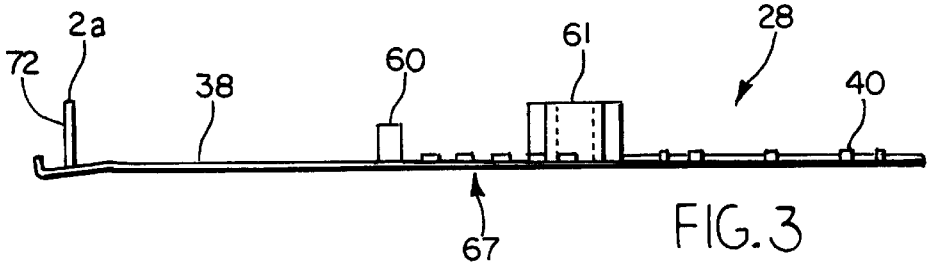
FIG. 3 is a side view of the housing of FIG. 2.
Figure 2A:
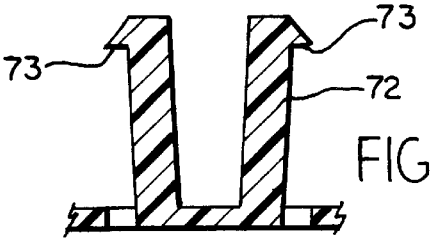
FIG. 2*a* is an exploded view of the cover latch of FIG. 2.
Figure 9:
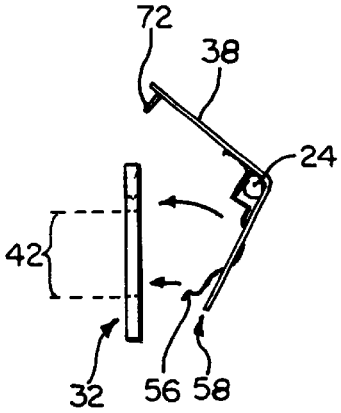
FIG. 9 is a side view of the key and assembly of FIG. 8.
Figure 8:
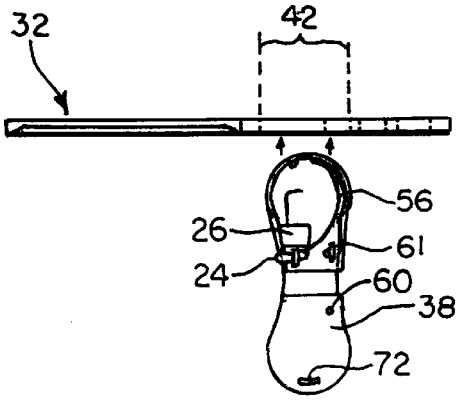
FIG. 8 is a top view of the key of FIG. 7 with a light assembly positioned for installation.

The final design element is the plastic clamshell case 28 with its living hinged cover 38, shown in FIGS. 2 and 3. It provides the needed mechanical platform for consistent, reliable and reproducible operation. The case 28 includes a hole 40 to secure the bend 57 of wire 56. Additional important functions are providing electrical insulation internally plus preventing external metallic items, like coins or other keys, from shorting out the battery 22 while the keys 32 are being carried around. It also provides the domed spring effect so that the wire 56 securely mounts different thickness of keys 32. In particular, the wire 56 protrudes from the housing 28, as shown in FIG. 9, and may be pulled further from the housing 28 to accommodate thicker keys. In this preferred version the piece parts are held in place using latch, channel, guide and snap locks that aid in piece part assembly at the factory. This includes some snap and lock elements that hold the LED 24 in place. This could also be done using insert-molding, over-molding or staking operations. The housing 28 has a first hinge 67 so that the housing 28 can lock over the LED 24, and a second hinge 68 so that the cover 38 may be lifted for battery replacement. There is a guide arm for mechanical support and a cover latch 72 that holds the cover 38 shut. FIG. 2*a* shows the cover latch 72 in more detail. The cover latch 72 goes in the space 62 between the two leads 64, 66, and the two catches 73 hook under the leads 64, 66. The cover 38 could also be a U-shaped slip-on type. Battery installation instructions and other information can be molded into the plastic cover 38. Battery 22 replacability adds value and convenience for the customer since he doesn't have to replace the entire mechanism 20 when the battery 22 runs low including making a special trip to the store to have an employee perform the replacement. It also eliminates the need for the store to provide battery 22 disposal which requires compliance with some complicated regulations.

The cover 38 can also provide an advertising vehicle. Adverting information is displayed on it, and the advertiser either subsidizes the cost or gives the light assembly 20 away as a promotion. In addition, any key 32 can be turned on at night and the stray light will be enough to illuminate nearby keys 32 so that you can find the one you're looking for. Making the plastic section over the LED 24 thinner or the cover material translucent will enhance this effect. Features could also be incorporated to improve grip, making the key easier to turn.

Installation, Design Features and Operation

Figure 24:
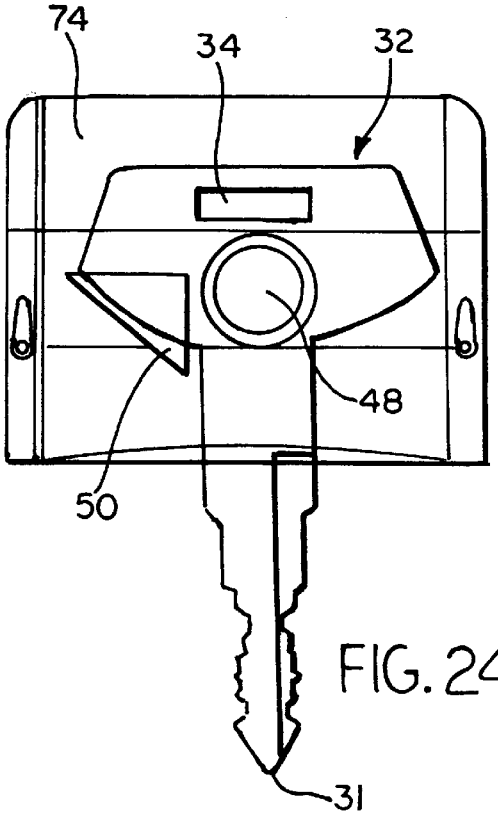
FIG. 24 is a front view of a key in a carrier to align with the punches of FIG. 23.
Figure 25:
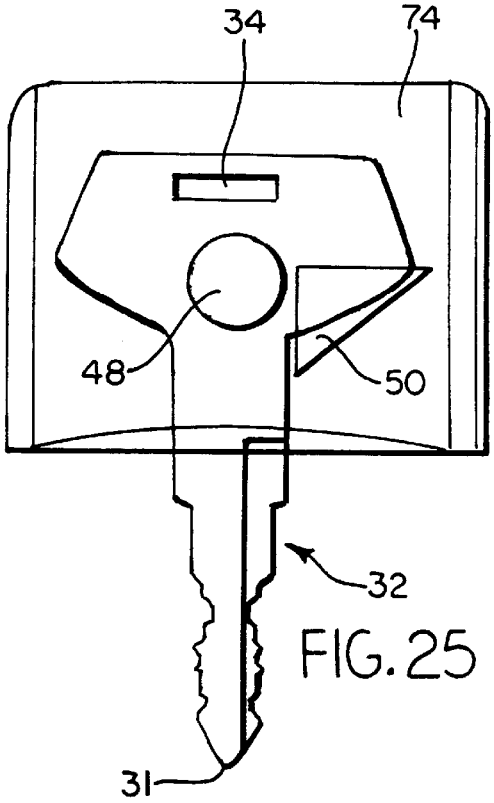
FIG. 25 is a back view of the key and carrier of FIG. 24.
Figure 26:
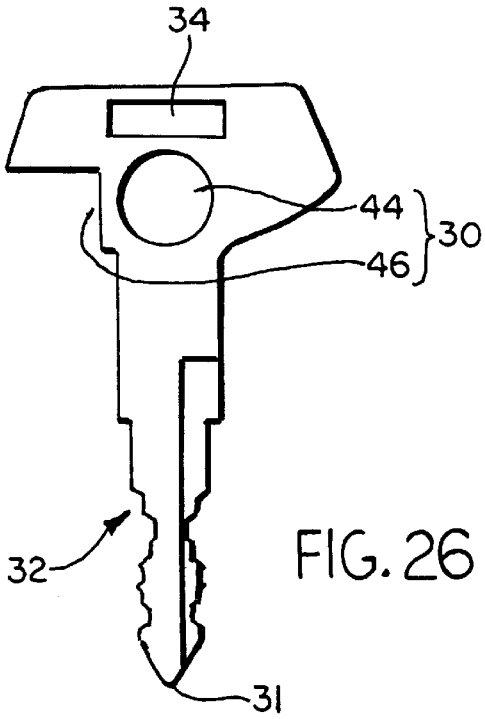
FIG. 26 is a front view of the key of FIG. 24 after the hole and notch have been punched.

The installation is accomplished by first indexing a key 32 to stationary stops, using a drop down plate or by aligning it with a pattern on a carrier 74, which is the preferred method, shown in FIGS. 24 and 25. The carrier approach especially provides a foolproof go/no-go indicator since the operator is able to see what is going to happen before it happens. If a punching error, in some unforeseen way, occurs to an existing key 32, since the cut pattern on the blade part of the key isn't affected since it isn't even in the punch area, the damaged key is simply set in the standard key cutting machine, and a new key is made. The site 30 is then punched again in this replacement key 32. The top of the key 32 is then punched with a special punch producing the specialized hole and notch site 30. Both features are produced with a single punch stroke. The site 30 could also be produced by drilling, milling, nibbling or grinding the needed features in the key 32, but punching is preferred.

Since the new hole 44, which is about 0.412" in diameter, is punched into only the metal where the key 32 is gripped when it is being used, and this hole 44 then holds the battery 22 and most of the mechanism, the assembly 20 is very small. This technology adds about 0.070" to only the thickness and then only at the top. Incorporating the battery holder, light 24 and switch mechanism 36 into the part that snaps into the hole 44 allows one hand operation. The user squeezes the sides as he is grasping the key 32 in the normal way. This activates the switch 36, turning on the light 24 and illuminating the keyhole. The key 32 is then inserted in the keyhole and turned in the normal. After using the key 32, when finger pressure 24 is released, the switch 36 disengages and this turns off the light 24. If the key 32 is grasped adjacent to the raised switch area or is not squeezed firmly, the key 32 can be used without turning on the light 24. This extends the battery 22 life. This is not difficult to do since most of the rotating force when turning a key 32 is applied at the outside edges of the key 32. The battery 22 should last over one year in normal use and this is just an option if the customer wants to use it. This key technology can also provide enough light for some important uses. For example, to see the ground when walking in the dark or to find dropped items in the dark. The yellow light color was selected to offer the most contrast and to make it easy to read maps which include red lines that can't be seen with red LEDs. Since an individual will probably carry more than one key with a light assembly 20, they can be used one after the other as the batteries 22 are drained to meet emergency type needs for extended continuous light.

All of the methods and/or apparatus disclosed and claimed herein can be made and executed without undue experimentation in light of the present disclosure. While the present invention has been described in terms of preferred embodiments, it will be apparent to those of skill in the art that variations may be applied to the methods and apparatus and in the steps or in the sequence of steps of the method described herein without departing from the concept, spirit and scope of the invention. More specifically, it will be apparent that certain agents may be substituted for the agents described herein while the same or similar results would be achieved. All such similar substitutes and modifications apparent to those skilled in the art are deemed to be within the spirit, scope and concept of the invention as defined by the appended claims.

What is claimed is:

1. A light assembly for attachment to a key, comprising:

a battery inserted into a hole punched out of a core area of said key;

a light source mounted in a notch on said key; and a switch connecting said light source to said battery.

2. The light assembly of claim 1, wherein said light source shines a light toward an end of said key when said switch is engaged.

3. The light assembly of claim 1, further comprising:

a housing placed around a core area of said key to cover said battery, said light source and said switch.

4. A light assembly for attachment to a key, comprising:

a battery inserted into a hole in said key:

a light source mounted on a notch punched out of a core area of said key; and a switch connecting said light source to said battery.

5. The light assembly of claim 4, wherein said light source shines a light toward an end of said key when said switch is engaged.

6. The light assembly of claim 4, further comprising:

a housing placed around a core area of said key to cover said battery, said light source and said switch.

7. A method of attaching a light assembly onto a key, comprising the steps of:

punching a hole into a core area of said key;

mounting a light source onto said key;

inserting a battery into said hole; and connecting a switch from said light source to said battery.

8. The method of claim 7, further comprising the step of:

punching a notch out of the core area of said key wherein said light source is mounted on said notch.

9. The method of claim 7 further comprising the step of:

attaching a housing around the core area of said key to cover said battery, said light and said switch.

10. The method of claim 7, further comprising attaching tape to said key between said key and a lead of said light source;

mounting said lead between said hole and said battery; and attaching a housing around the core area of said key to hold said tape against said key.

* * * * *